US005727818A

United States Patent [19]

Schmeida

[11] Patent Number: 5,727,818

[45] Date of Patent: Mar. 17, 1998

[54] ERASABLE LABEL KIT

[76] Inventor: Peter Schmeida, P.O. Box 1796, Stow, Ohio 44224

[21] Appl. No.: 622,996

[22] Filed: Mar. 28, 1996

[51] Int. Cl.[6] ..... B42D 15/00

[52] U.S. Cl. ..... 283/81; 283/101; 283/94; 283/67

[58] Field of Search ..... 283/81, 101, 94, 283/67

[56] References Cited

U.S. PATENT DOCUMENTS

| | | | |
|---|---|---|---|
| 4,757,901 | 7/1988 | Wood | 283/70 X |
| 4,884,826 | 12/1989 | Skagsvol | 281/2 |
| 5,024,332 | 6/1991 | Stachler | 283/81 X |
| 5,178,420 | 1/1993 | Shelby | 293/94 |
| 5,186,499 | 2/1993 | Mason | 283/81 |
| 5,290,066 | 3/1994 | Mody | 283/81 X |
| 5,431,451 | 7/1995 | Bork et al. | 283/67 X |

FOREIGN PATENT DOCUMENTS

| | | | |
|---|---|---|---|
| 90/03277 | 4/1990 | WIPO | 283/94 |
| 92/05035 | 4/1992 | WIPO | 283/67 |

*Primary Examiner*—Frances Han

*Attorney, Agent, or Firm*—Donald A. Bergquist

[57] ABSTRACT

A labeling system and kit therefor that includes a writing surface for dry-erase markers wherein the writing surface has a transparent protective covering to prevent inadvertent erasure of indicia applied thereto using such a dry-erase marker and wherein the protective covering may be lifted to erase or apply indicia to the writing surface. Alternative embodiments include self-adhesive labels and magnetic labels as well as a kit that includes an erasing tool and/or dry-erase marker. The self-adhesive labels find their use in labeling packages containing reusable magnetic media such as video tape cassettes and computer floppy disks, folders and stationery, storage shelves and bins, and the like. The magnetic labels might find application as labels on metal shelves, bins, equipment and the like.

6 Claims, 3 Drawing Sheets

ERASABLE LABEL KIT

BACKGROUND OF THE INVENTION

1. Field of the Invention

The present invention relates generally to labels and more specifically it relates to a label kit for items for which the labelling is changed frequently, such as on containers for reusable recording media—like video cassettes or computer floppy diskettes—to reflect a change in the content of information stored on the media. The invention may also be applied to use as an identification label for binders and stationery, shelf or bin tags wherever shelf or bin contents are changed frequently, and for any other similar use. A particular feature of the invention is the ease with which indicia are erased, although the indicia are protected against accidental erasure.

2. Description of the Prior Art

Some magnetic recording media are used over and over again, with the information recorded thereon changing frequently. Proper identification of an individual video cassette or floppy diskette for a computer can save hours of searching to find the information one desires to retrieve. Proper identification of such media is greatly simplified if the old labelling is easily removed and the new labeling cannot be removed inadvertently.

At the present time, adhesive paper strips are secured to the cassette and disk and the location and identification of the program is written on the strip so that the contents can be readily identified. When the magnetic medium is erased and another program recorded, the original indicia must be crossed out, erased, or another paper strip must be applied in addition to or in place of the original. Erasure of information while the paper strip is on a floppy disk, for one example, usually requires applying pressure that is transmitted to the magnetic film of the recording medium and can cause irreparable damage thereto. For other uses, erase of erasure is just a great convenience.

An approach to this problem has been presented in U.S. Pat. No. 4,757,901, issued to Woods in 1988. The Woods patent presents an erasable label kit that uses a "dry-erase marker pen" on a coated polyester film and an eraser having polyester pile fabric that easily removes the indicia. Particularly important to the Woods patent is that the "... particular film material and ink in combination is highly resistant to accidental erasure, specifically in normal handling. Other write on/wipe off material will either allow very easy erasure and smudge if touched or the ink will be permanently placed thereon." Thus, the marker and film of the Woods patent are described in the claims as "easily removed from each of said labels only when desired", are made so by the selection of the marker and film combination and are clearly not of the type described in the Woods patent as one that would "allow very easy erasure".

A product similar to that of the Woods patent, but using an eraser that appears to be a type of rubber eraser is marketed under the trade name, LUMOLABELS erasable labeling system, by Staedtler Inc., of Chatsworth, Calif. Although the composition of the film comprising the writing surface has not been analyzed to learn whether it is polyester, the purpose and use of these labels are much as described in the Woods patent.

In contrast to these prior art items, the present invention employs a dry-erase marker of a type that is very easily erased or smudged and would be therefore unsuitable for use as taught by Woods or in the marketplace by Staedtler Inc.

The ease of erasure is considered an important feature in the intended use. To protect the indicia from being smudged, the present invention includes a protective transparent film that is selectably positioned to cover and protect the indicia or to uncover and expose the indicia for easy erasure and re-marking.

Numerous other patents have taught a protective film covering a label, but the film in each of those patents is for protecting the indicia-bearing surface of the label from dirt, not from accidental erasure. In contrast, the protective transparent film of the present invention is solely to prevent accidental erasure of indicia applied with a dry-erase marker of the type well known for its ease of erasure.

An embodiment of the invention of particular usefulness as a shelf or bin tag comprises either an adhesive label or a magnetized sheet having a writing surface and a transparent protective cover therefor.

A cord-like fibrous core held in a cylindrical holder can be used as a convenient eraser in combination with the present invention, although the user's finger or a tissue will serve equally well as an eraser.

SUMMARY OF THE INVENTION

It is a primary object of this invention to provide a kit that includes a dry-erase marking pen of the type that produces a very-easily erased mark, an adhesive label having a non-porous writing surface for receiving marks from such a marking pen and also having a protective transparent film that is selectably positioned to cover and protect the indicia or to uncover and expose the indicia for easy erasure and re-marking.

It is an object of this invention to provide a label that is made up of the following layers, listed from the top to the bottom:

a. a transparent film overlaying and permanently affixed along one edge thereof and temporarily affixed along an opposite edge thereof to;

b. a non-porous writing surface for receiving indicia from a dry-erase marking pen, which writing surface overlays and is permanently affixed to;

c. an opaque layer to provide contrast between the indicia from the marking pen, this opaque layer being permanently affixed to;

d. an adhesive layer having permanent adhesive on the top surface and the bottom surface thereof, the bottom surface being thereby permanently affixed to a substrate when the label is in use, but being protected before being applied to said substrate by;

e. a release paper to which the permanent adhesive of the adjacent layer will releasably adhere.

It is an object of this invention to provide a label that is made up of the following layers, listed from the top to the bottom:

a. a transparent film overlaying and permanently affixed along one edge thereof and temporarily affixed along an opposite edge thereof to;

b. an opaque non-porous writing surface for removably receiving indicia from a dry-erase marking pen and for providing contrast between the indicia from said marking pen, which writing surface overlays and is permanently affixed to;

c. an adhesive layer having permanent adhesive on the top surface and the bottom surface thereof, the bottom surface being thereby permanently affixed to a substrate when the label is in use, but being protected before being applied to said substrate by;

d. a release paper to which the permanent adhesive of the adjacent layer will releasably adhere.

It is an object of this invention to provide a label that is made up of the following layers, listed from the top to the bottom:

a. a transparent film overlaying and permanently affixed along one edge thereof and temporarily affixed along an opposite edge thereof to;

b. an opaque non-porous writing surface for removably receiving indicia from a dry-erase marking pen and for providing contrast between the indicia from said marking pen, which writing surface overlays and is permanently affixed to;

c. a flat magnet.

It is an object of this invention to provide a label that is made up of the following layers, listed from the top to the bottom:

a. a transparent film overlaying and permanently affixed along one edge thereof and temporarily affixed along an opposite edge thereof to;

b. a non-porous writing surface for receiving indicia from a dry-erase marking pen, which writing surface overlays and is permanently affixed to;

c. an opaque layer to provide contrast between the indicia from the marking pen, this opaque layer being permanently affixed to;

d. a flat magnet.

BRIEF DESCRIPTION OF THE DRAWINGS

This invention will be most easily understood by referring to the figures attached hereto, wherein.

DETAILED DESCRIPTION OF THE PREFERRED EMBODIMENTS

The various figures attached hereto are useful in describing this invention. In these figures, the same part is identified throughout by the use of a unique reference number. Also, related parts are identified throughout by the use of such reference numbers with the addition of a prime mark (i.e., '), a double-prime mark (i.e., "), a triple-prime mark (i.e., '"), or a superscript o (i.e., °), thereby to indicate that they are related to similar parts in other figures.

Figure 1:
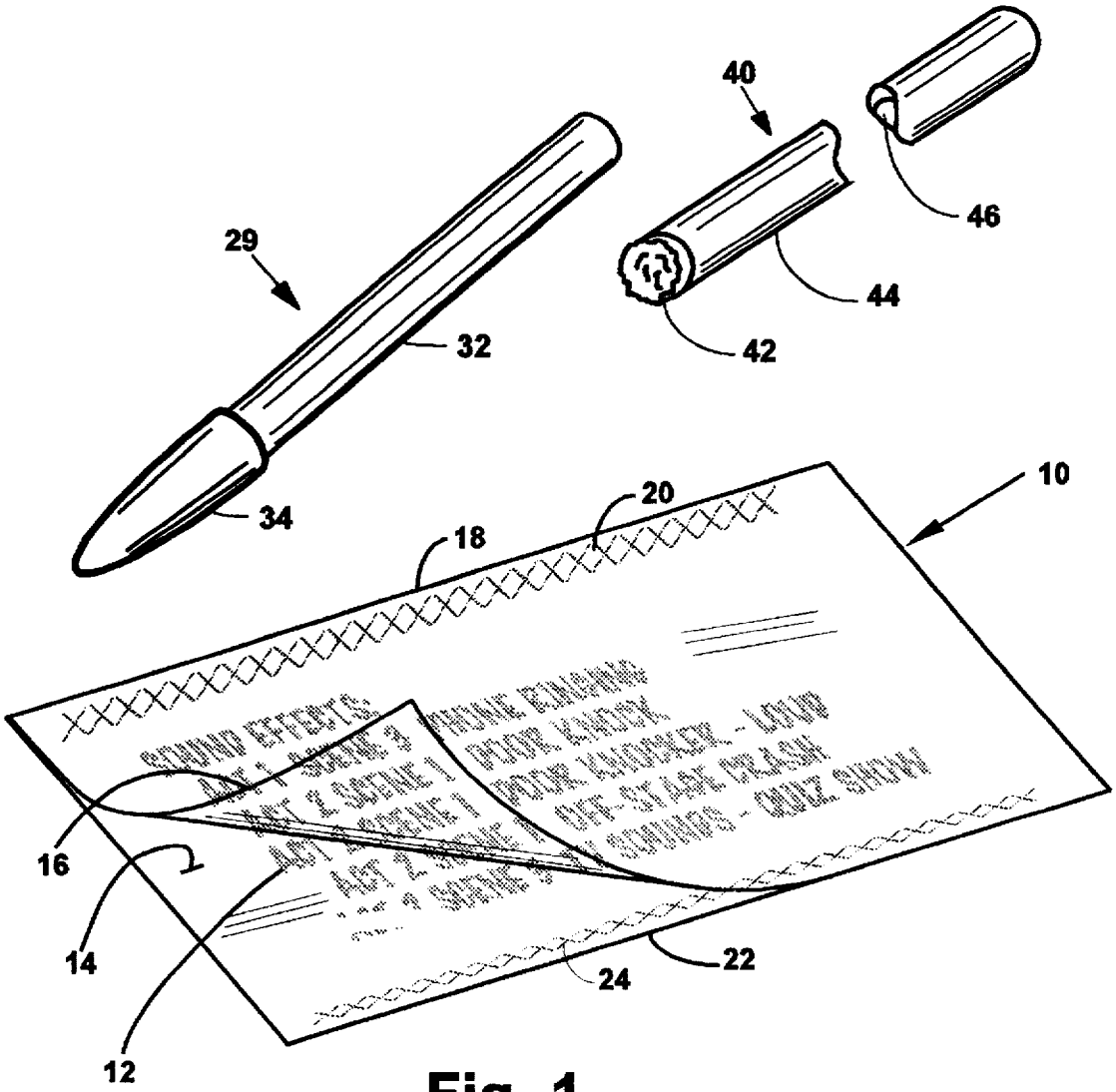
FIG. 1 illustrates a label kit of this invention in a perspective view.

The kit shown in FIG. 1 comprises a label 10 according to this invention, a dry-erase marking pen 29, and an erasing tool 40. It can be seen that indicia 12 on the writing surface 14 of the label 10 are clearly visible through the transparent protective cover 16 that may be lifted to expose the writing surface for erasure of the indicia and writing on the writing surface.

In the example shown, adhesive is indicated along two opposing edges of the label, which adhesive bonds the protective cover to the writing surface. Along a first edge 18 is present a permanent adhesive 20 to fixedly hold the protective cover 16 to the writing surface 14. Along the opposing edge 22 is a much less tenacious adhesive 24 of the type used for easily-removed notes, tapes, and labels, such as are sold by the 3M Corporation under the name POST-IT®. Other adhesive systems can be used to achieve the same purpose as met by this particular family of adhesives. Applicant has seen some adhesives that gain the required ease of release by limiting the amount and pattern of adhesive applied to a surface or by applying a release agent to the surface opposing the adhesive to moderate the adhesive properties of an otherwise tenacious adhesive. It is only important that a portion of the writing surface be kept free of adhesive to provide a writing surface that may be wiped clean of indicia deposited by a dry-erase ink marker.

The dry-erase marker of the kit of the present invention is one of the type that is commonly available for writing on smooth surfaces by depositing ink that does not penetrate the smooth writing surface and forms a dry mark that is easily wiped from the surface by a dry tool, a damp tool, or one's fingertip. The ink-holding body 32 has a felt tip for applying ink and a cap 34 to protect the tip from drying out. Such felt-tipped writing implements are well known in the office products industry and are used extensively by public speakers and educators. Broad-tipped markers are used on boards, much as one would use chalk on a chalkboard. Fine-tipped markers are more often used on plastic film used on overhead projectors that project onto a screen the indicia created on the film. These marking tools are especially useful in that they are easily erased to re-use the plastic film or to easily change the indicia presented to a group, as in teaching editing skills, and the like. The markers are available in a variety of colors, which fact adds to the visual impact in use and their overall usefulness. Applicant does not claim to have invented the marker present in the kit.

The erasing tool 40 of the kit is an optional tool that users of the kit may find helpful. The simplest form of such a tool is illustrated, although much more complex tools could be created using the same principles as are exhibited here. The erasing medium 42 is a bundle of fibrous material, either of natural or synthetic fibers. Cotton fibers are expected to work well, for example, but one would also expect polyester fibers or other synthetics would also be suitable. The erasing medium 42 is mounted in a hollow, substantially rigid tube 44 to conveniently hold the medium and to create a pencil-like tool for erasing. The medium extends through at least a significant portion of the length of the tube, as is shown at 46. The tube 44 could be of wood or plastic and could be a plastic tube having significant flexibility and still be useful in its function. It merely provides a better grip on an otherwise extremely flexible erasing medium.

The main element of this invention is the label 10 itself. This is a self-adhesive label having a smooth writing surface 14 that resists penetration by inks but will receive on its surface ink from a felt-tipped dry-erase marker. The marker of choice is one that deposits ink of a type that leaves an essentially dry mark that can be easily brushed or wiped from the writing surface. Whereas such marks are subject to inadvertent erasure, the label includes a protective transparent film 16 that is selectably placed in a first protective position wherein the film covers and protects the indicia left by a dry-erase marker or in a second position that leaves the indicia exposed and unprotected, thereby to provide easy removal of the indicia and writing new indicia upon the writing surface 14.

Figure 2:
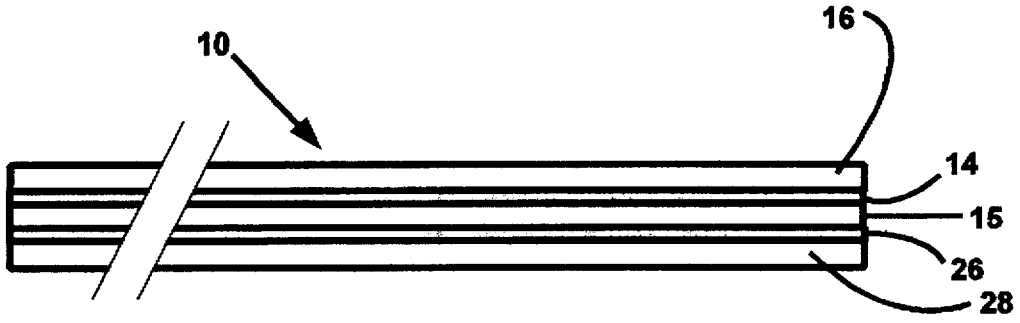
FIG. 2 illustrates an edge view of the label of this invention, showing the various layers thereof.
Figure 7:
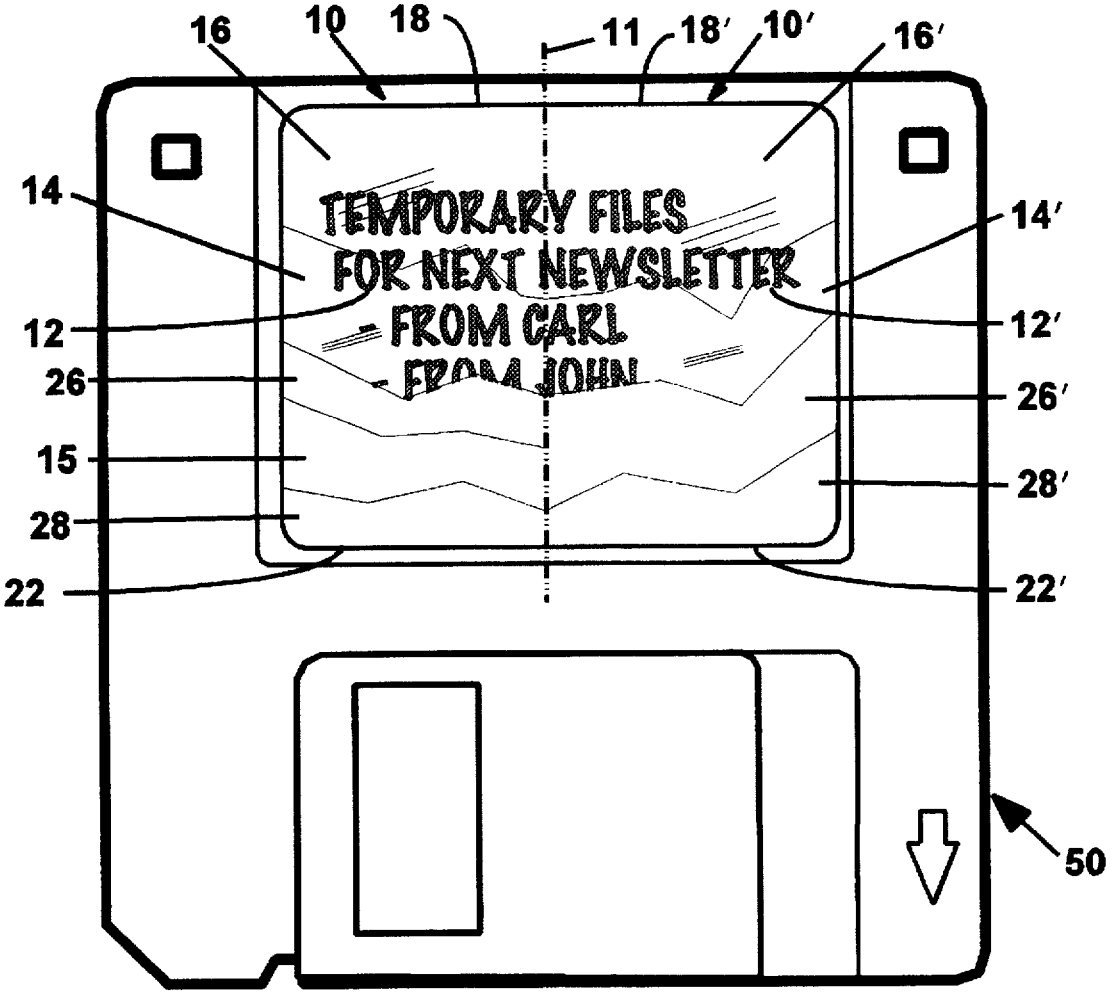
FIG. 7 illustrates a label of this invention in use on a computer diskette and showing by cutaway the various layers of the label in the two different embodiments also shown in FIGS. 2 and 3.

A first embodiment of the label of this invention is shown in greater detail in an edge view in FIG. 2 and in a cutaway view in FIG. 7, where this first embodiment is illustrated to the left of the centerline 11. FIG. 7 shows the label 10 in use attached to a computer diskette 50. The top layer in each figure is a transparent film 16 overlaying and permanently affixed along one edge 18 thereof and temporarily affixed along an opposite edge 22 thereof to a writing surface 14. The writing surface 14 is a non-porous surface for removably receiving indicia 12 that have been placed thereon using a dry-erase marking pen 29. In this embodiment the writing surface 14 is a clear, transparent coating applied to an opaque layer 15 that provides contrast for the indicia from the marking pen. In common practice in the manufacture of labels, such an opaque layer is made of paper. This opaque layer 15 is permanently affixed to an adhesive layer 26. In common practice in the manufacture of labels, the adhesive layer 26 is a web having permanent adhesive on both sides thereof. The same function could be performed by an adhesive coating applied to the bottom surface of the opaque layer 15. It should be understood that both of these options are intended in the words "an adhesive layer having permanent adhesive on the top surface and the bottom surface thereof". In use, it is this adhesive layer that binds the label to the article to which the label is to be attached. The adhesive layer 26 is removably affixed to a release paper 28 that is to be removed by the user when he attaches the label to an article to be labeled. The use of such release paper is in common practice in the making and use of labels.

Figure 3:
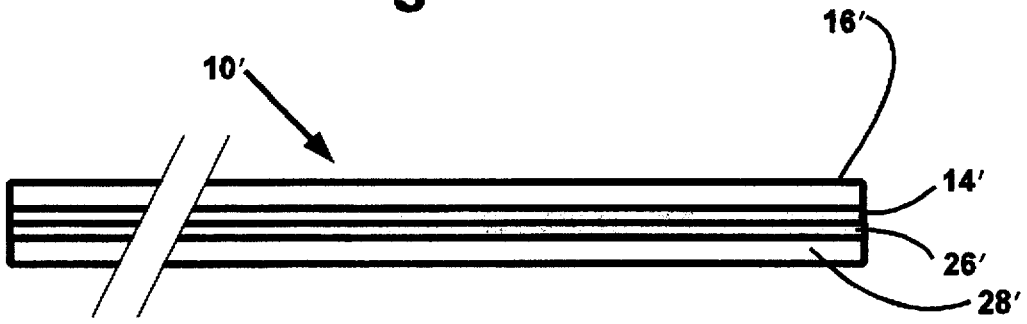
FIG. 3 illustrates an edge view of a second embodiment of the label of this invention, showing the various layers thereof.

A second embodiment of the label of this invention is shown in greater detail in an edge view in FIG. 3 and in a cutaway view in FIG. 7, where this second embodiment is illustrated to the right of the centerline 11. FIG. 7 shows the label 10' in use attached to a computer diskette 50. The top layer in each figure is a transparent film 16' overlaying and permanently affixed along one edge 18' thereof and temporarily affixed along an opposite edge 22' thereof to a writing surface 14'. The writing surface 14' is a non-porous surface for removably receiving indicia 12' that have been placed thereon using a dry-erase marking pen. In this embodiment the writing surface 14' is an opaque layer that provides contrast for the indicia from the marking pen. This layer may be of a thermoplastic material, for instance. This opaque layer writing surface 14' is permanently affixed to an adhesive layer 26'. In common practice in the manufacture of labels, the adhesive layer 26' is a web having permanent adhesive on both sides thereof. The same function could be performed by an adhesive coating applied to the bottom surface of the opaque layer 14'. It should be understood that both of these options are intended in the words "an adhesive layer having permanent adhesive on the top surface and the bottom surface thereof". In use, it is this adhesive layer that binds the label to the article to which the label is to be attached. The adhesive layer 26' is removably affixed to a release paper 28' that is to be removed by the user when he attaches the label to an article to be labeled. The use of such release paper is in common practice in the making and use of labels.

Figure 4:
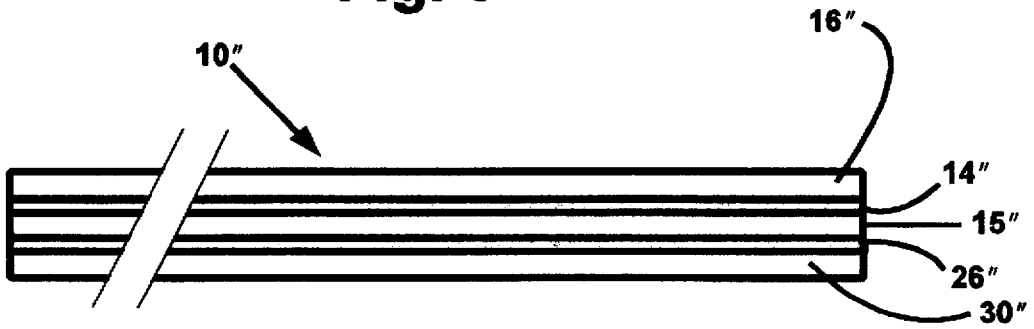
FIG. 4 illustrates an edge view of a third embodiment of the label of this invention, one wherein it is on a magnetized backing, showing the various layers thereof.

Yet another embodiment of this invention is illustrated in FIG. 4. Because it includes a magnetized backing, it is not considered suitable for use on or around magnetic media, such as tape cassettes or computer diskettes.

FIG. 4 shows in an edge view the layers of this embodiment of the label 10". The top layer of the label 10" is a transparent film 16" that overlays and is permanently affixed along one edge thereof and temporarily affixed along an opposite edge thereof to a writing surface 14". The writing surface 14" is a non-porous surface for removably receiving indicia that have been placed thereon using a dry-erase marking pen 29. In this embodiment the writing surface 14" is a clear, transparent coating applied to an opaque layer 15" that provides contrast for the indicia from the marking pen. In common practice in the manufacture of labels, such an opaque layer is made of paper. This opaque layer 15" is permanently affixed to an adhesive layer 26". In common practice in the manufacture of labels, the adhesive layer 26" is a web having permanent adhesive on both sides thereof. The same function could be performed by an adhesive coating applied to the bottom surface of the opaque layer 15". This adhesive layer binds the opaque layer 15" to a magnet 30". The magnet may be a rigid magnet of common magnetized material. Steel, nickel, ferrites, and other known materials are used to make such artificial magnets of any desired shape and size. Alternatively, the magnet could be a flexible magnet comprising magnetized particles suspended in a flexible matrix. Such a flexible magnet is well known and commonly utilized in magnetic signs and magnetic business cards.

Figure 5:
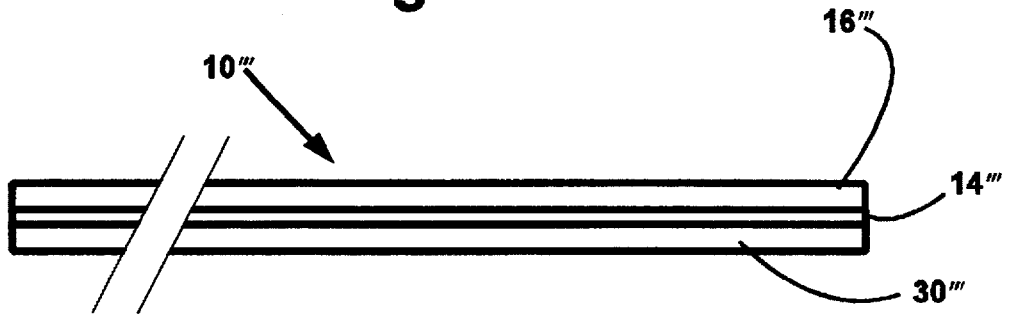
FIG. 5 illustrates an edge view of a fourth embodiment of the label of this invention, one wherein it is on a magnetized backing, showing the various layers thereof.

In a second embodiment involving a magnet backing, shown in FIG. 5, the writing surface is applied directly to the magnet, much the way magnetic business cards are made using flexible magnets. In this case, however, the magnet may be a rigid, magnet of the types previously described, or it could be a flexible magnet comprising magnetized particles suspended in a flexible matrix. There is no intervening separate opaque layer as the writing surface is an opaque layer that provides contrast for making the indicia easily visible.

The top layer of the label 10'" in FIG. 5 is a transparent film 16'" overlaying and permanently affixed along one edge thereof and temporarily affixed along an opposite edge thereof to a writing surface 14'". The writing surface 14'" is a non-porous surface for removably receiving indicia that have been placed thereon using a dry-erase marking pen. In this embodiment the writing surface 14'" is an opaque layer that provides contrast for the indicia from the marking pen. This layer may be of a thermoplastic material, for instance. This opaque layer writing surface 14'" is permanently affixed to a flat magnet 30'". The magnet may be a rigid, magnet of the types previously described, or it could be a flexible magnet comprising magnetized particles suspended in a flexible matrix wherein the matrix is of a suitable material to form as its integral top surface the desired writing surface for very easily-erased dry-erase markers. Whether rigid or flexible, the magnet must provide suitable contrast for the indicia to be easily seen.

Figure 6:
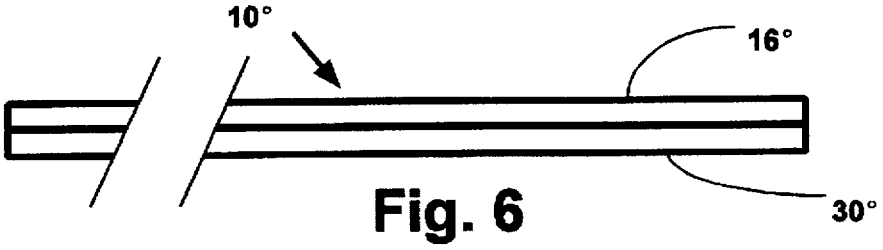
FIG. 6 illustrates an edge view of another embodiment of the label of this invention, one wherein it is on a magnetized backing, showing the various layers thereof.

A final embodiment of this invention is presented in FIG. 6. In this figure is shown what may be the simplest form of the invention—one in which the writing surface is an integral part of the magnet. The top layer of the label 10° in FIG. 5 is a transparent film 16° overlaying and permanently affixed along one edge thereof and temporarily affixed along an opposite edge thereof to a writing surface that is the top surface of a flat magnet 30°. The magnet may be a rigid magnet of the types previously described, or it could be a flexible magnet comprising magnetized particles suspended in a flexible matrix wherein the matrix is of a suitable material to form as its integral top surface the desired writing surface for very easily-erased dry-erase markers.

It is clear that this invention may take on additional forms and still be within the spirit of this disclosure. It is therefore intended that the scope of this invention be limited only by the claims hereto appended.

I claim:

1. A label that comprises the following layers, listed from the uppermost layer down:

a. a transparent film overlaying and permanently affixed along one edge thereof and temporarily affixed along an opposite edge thereof to;

b. a non-porous writing surface for removably receiving indicia from a dry-erase marking pen, which writing surface is a clear, transparent coating applied to;

c. an opaque layer to provide contrast for the indicia from the marking pen; and d. a substantially flat magnet permanently affixed to the underside of said opaque layer.

2. A label according to the teachings of claim 1, wherein said magnet is a flexible magnet comprising magnetized particles in a flexible matrix.

3. A label that comprises the following layers, listed from the uppermost layer down:

a. a transparent film overlaying and permanently affixed along one edge thereof and temporarily affixed along an opposite edge thereof to;

b. an opaque non-porous writing surface for removably receiving indicia from a dry-erase marking pen and for providing contrast for the indicia from said marking pen; and c. a substantially flat magnet permanently affixed to the underside of said opaque layer.

4. A label according to the teachings of claim 3, wherein said magnet is a flexible magnet comprising magnetized particles in a flexible matrix.

5. A label that comprises the following layers, listed from the uppermost layer down:

a. a transparent film overlaying and permanently affixed along one edge thereof and temporarily affixed along an opposite edge thereof to;

b. an opaque non-porous writing surface for removably receiving indicia from a dry-erase marking pen and for providing contrast for the indicia from said marking pen wherein said writing surface is the surface of a magnet.

6. A label according to the teachings of claim 5 wherein said magnet is a flexible magnet comprising magnetized particles in a flexible matrix.

* * * * *